US009144340B2

(12) United States Patent
Mayer

(10) Patent No.: US 9,144,340 B2
(45) Date of Patent: Sep. 29, 2015

(54) PRIVACY CURTAIN ASSEMBLY WITH CLEANABLE PANELS

(71) Applicant: THE FEINSTEIN INSTITUTE FOR MEDICAL RESEARCH, Manhasset, NY (US)

(72) Inventor: Lorenz W. Mayer, Freeport, NY (US)

(73) Assignee: THE FEINSTEIN INSTITUTE FOR MEDICAL RESEARCH, Manhasset, NY (US)

( * ) Notice: Subject to any disclaimer, the term of this patent is extended or adjusted under 35 U.S.C. 154(b) by 0 days.

(21) Appl. No.: 14/024,827

(22) Filed: Sep. 12, 2013

(65) Prior Publication Data

US 2014/0069591 A1 Mar. 13, 2014

Related U.S. Application Data

(60) Provisional application No. 61/700,022, filed on Sep. 12, 2012.

(51) Int. Cl.

| | |
|---|---|
| ***E06B 3/80*** | (2006.01) |
| ***A47H 23/00*** | (2006.01) |
| ***E06B 9/24*** | (2006.01) |
| *A47H 23/08* | (2006.01) |

(52) U.S. Cl.

CPC *A47H 23/00* (2013.01); *E06B 9/24* (2013.01); *A47H 23/08* (2013.01); *A47H 2201/00* (2013.01)

(58) Field of Classification Search

CPC ..... A47H 23/08; A47H 23/02; A47H 23/04; A47H 23/00; A47H 2023/00; A47H 2023/02; A47H 2023/025; A47K 3/302; A47K 3/38; A47K 3/30

USPC ..... 160/330, 179, 237, 405, DIG. 6, DIG. 7; 4/558, 608

See application file for complete search history.

(56) References Cited

U.S. PATENT DOCUMENTS

| | | | | | |
|---|---|---|---|---|---|
| 2,500,074 | A | * | 3/1950 | Hill | 160/123 |
| 2,608,250 | A | * | 8/1952 | Meyer | 160/349.2 |
| 3,035,275 | A | * | 5/1962 | Strebeigh | 4/608 |
| 3,321,003 | A | * | 5/1967 | Boerner | 160/237 |
| 4,377,195 | A | * | 3/1983 | Weil | 160/237 |
| 4,550,038 | A | * | 10/1985 | Becker et al. | 428/12 |
| 5,148,580 | A | * | 9/1992 | Dyckow | 24/303 |
| 6,142,210 | A | * | 11/2000 | Isoda | 160/124 |
| 6,154,894 | A | * | 12/2000 | Alexander et al. | 4/609 |
| 6,163,899 | A | * | 12/2000 | Leonard | 4/558 |
| 6,254,527 | B1 | * | 7/2001 | August | 600/27 |
| 6,474,396 | B1 | * | 11/2002 | Toder | 160/237 |
| 6,591,432 | B1 | * | 7/2003 | Feinstein et al. | 4/558 |
| 6,957,684 | B2 | * | 10/2005 | Rodriguez | 160/330 |
| 7,487,818 | B2 | * | 2/2009 | Zimmer | 160/348 |
| 7,559,352 | B2 | * | 7/2009 | Rodriguez | 160/330 |
| 7,600,274 | B2 | * | 10/2009 | Washington | 4/608 |

(Continued)

*Primary Examiner* — Katherine Mitchell
*Assistant Examiner* — Johnnie A Shablack
(74) *Attorney, Agent, or Firm* — Tarolli, Sundheim, Covell & Tummino LLP

(57) ABSTRACT

A privacy curtain assembly includes a main curtain portion. The main curtain portion includes a first side, a second side, and oppositely disposed leading edges located between the first and second sides. The privacy curtain assembly also includes at least one cleanable, wipable panel that is permanently affixed to one of the leading edges of the main curtain portion. The at least one panel is configured to be cleaned while permanently affixed to the main curtain portion.

18 Claims, 13 Drawing Sheets

(56) References Cited

U.S. PATENT DOCUMENTS

| | | | | |
|---|---|---|---|---|
| 7,989,046 | B2 | 8/2011 | DiNunzio | |
| 8,113,265 | B2 * | 2/2012 | Hardison et al. | 160/273.1 |
| 8,479,800 | B2 * | 7/2013 | Graneto et al. | 160/341 |
| 2007/0051479 | A1 * | 3/2007 | Nien | 160/330 |
| 2007/0215296 | A1 * | 9/2007 | Voutour | 160/330 |
| 2007/0261803 | A1 * | 11/2007 | Alexander et al. | 160/341 |
| 2008/0017332 | A1 * | 1/2008 | Daly | 160/330 |
| 2008/0087389 | A1 * | 4/2008 | Govan | 160/330 |
| 2009/0044888 | A1 | 2/2009 | Ganey | |
| 2009/0288786 | A1 * | 11/2009 | Graneto et al. | 160/344 |
| 2010/0224331 | A1 * | 9/2010 | Stoughton | 160/340 |
| 2010/0243181 | A1 * | 9/2010 | O'Connor | 160/236 |
| 2011/0284172 | A1 * | 11/2011 | Seitz | 160/123 |
| 2012/0037324 | A1 * | 2/2012 | Graneto, III | 160/341 |
| 2012/0222826 | A1 * | 9/2012 | Foss et al. | 160/237 |
| 2013/0061386 | A1 * | 3/2013 | Vagliardo | 4/558 |
| 2013/0075050 | A1 * | 3/2013 | Colledge | 160/237 |
| 2013/0239318 | A1 * | 9/2013 | Wang | 4/608 |

* cited by examiner

PRIVACY CURTAIN ASSEMBLY WITH CLEANABLE PANELS

CROSS-REFERENCE TO RELATED APPLICATION

This application claims the benefit of U.S. Provisional patent application No. 61/700,022, filed on 12 Sep. 2012 and entitled PRIVACY CURTAIN ASSEMBLY WITH CLEANABLE PANELS, the entire contents of which is incorporated herein by reference.

TECHNICAL FIELD

The present disclosure relates generally to a privacy curtain and, more particularly, to a privacy curtain having one or more panels that may be cleaned, wiped, and disinfected in place by, for example, wiping, without removing the panels and/or curtain.

BACKGROUND

Hanging curtains are often used to divide larger hospital rooms into individual patient area or cubicles. They are useful in providing a patient with his or her own private cubicle when other patients are in the room or in higher traffic settings in a hospital or other healthcare facility, such as an emergency room or post-operative recovery room. Often, the cubicle curtains are attached by hooks or other means that are slidably mounted to curtain tracks attached to the ceiling of the hospital room or other healthcare facility. The slidable mounting makes it convenient for the curtains to be moved back and forth between an open and closed position so that a health care professional, visitor, or the patient may enter and exit the cubicle with ease.

Typically, hospital cubicle curtains are made from cloth or a cloth-like material. Due to the fibrous nature of this type of material, the cubicle curtains often become a haven for bacteria and microbial growth. Bacteria and germs are transmitted to and from the cubicle curtains through the air or by physical contact, often by the hands of a health care provider who did not have an opportunity to wash his or her hands after examining the patient and before exiting the cubicle. Many curtains are treated with anti-microbial chemicals to reduce bacterial transmission. These treatments have some effect on airborne transmission but are considerably less effective on contact transmission, which occurs on the edges of the curtain every time someone opens and closes the curtain by its edges.

SUMMARY

The present disclosure is generally directed to a privacy curtain and, more particularly, to a privacy curtain having one or more panels that may be cleaned and disinfected in place by, for example, wiping, without removing the panels and/or curtain.

In one aspect of the present disclosure, a privacy curtain assembly includes a main curtain portion. The main curtain portion includes a first side, a second side, and oppositely disposed leading edges. The privacy curtain assembly also includes at least one cleanable, wipable panel permanently affixed to one of the leading edges of the main curtain portion. The at least one panel is configured to be cleaned and disinfected while permanently affixed to the main curtain portion.

In another aspect of the present disclosure, a privacy curtain assembly consists of a main curtain portion. The main curtain portion includes a first side and a second side oppositely disposed from the first side. Each of the first and second sides includes first and second mating portions, respectively. The main curtain portion also includes oppositely disposed first and second leading edges, and an attachment portion. The attachment portion includes an upper attachment portion and a lower attachment portion. The lower attachment portion connects the upper attachment portion to the main curtain portion and is made of a flexible, mesh-like material. The upper attachment portion includes an attachment mechanism. Each of the upper and lower attachment portions extends along an entire width of the main curtain portion. A first cleanable, wipable panel is permanently affixed to the mating portion of the main curtain portion and covers an entire length of the first leading edge. The first panel includes first and second portions in contact with the first and second sides of the main curtain portion, respectively. The first and second portions are separated by a crease line that envelops the first leading edge. The first panel also includes a first surface in contact with the first and second sides of the main curtain portion and a second surface exposed to an ambient environment. A second cleanable, wipable panel is permanently affixed to the mating portion of the main curtain portion and covers an entire length of the second leading edge. The second panel includes first and second portions in contact with the first and second sides of the main curtain portion, respectively. The first and second portions are separated by a crease line that envelops the second leading edge. The second panel also includes a first surface in contact with the first and second sides of the main curtain portion and a second surface exposed to the ambient environment. Each of the first and second panels is made of a material that is anti-static, non-absorbent, anti-bacterial, self-deodorizing, flame-resistant, fluid-resistant, and/or moisture-resistant. The first and second panels are configured to be cleaned and disinfected while permanently affixed to the main curtain portion and while the privacy curtain assembly is suspended above a floor.

BRIEF DESCRIPTION OF THE DRAWINGS

The foregoing and other features and advantages of the present disclosure will become apparent to one skilled in the art upon consideration of the following description of the disclosure and the accompanying drawings, in which.

DETAILED DESCRIPTION

Figure 1A:
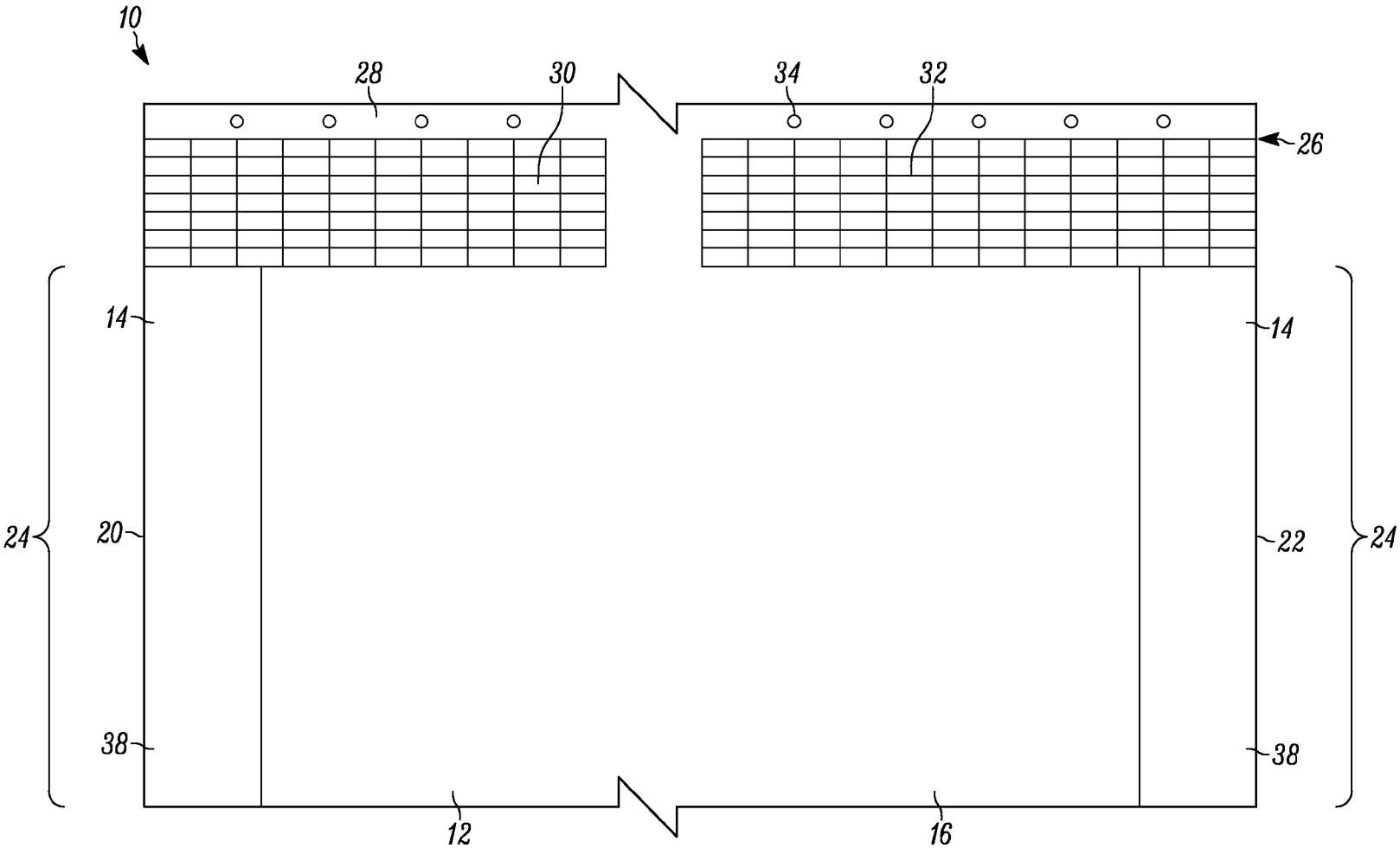
FIG. 1A is a schematic illustration showing a first side of a privacy curtain assembly constructed in accordance with one aspect of the present disclosure.
Figure 1B:
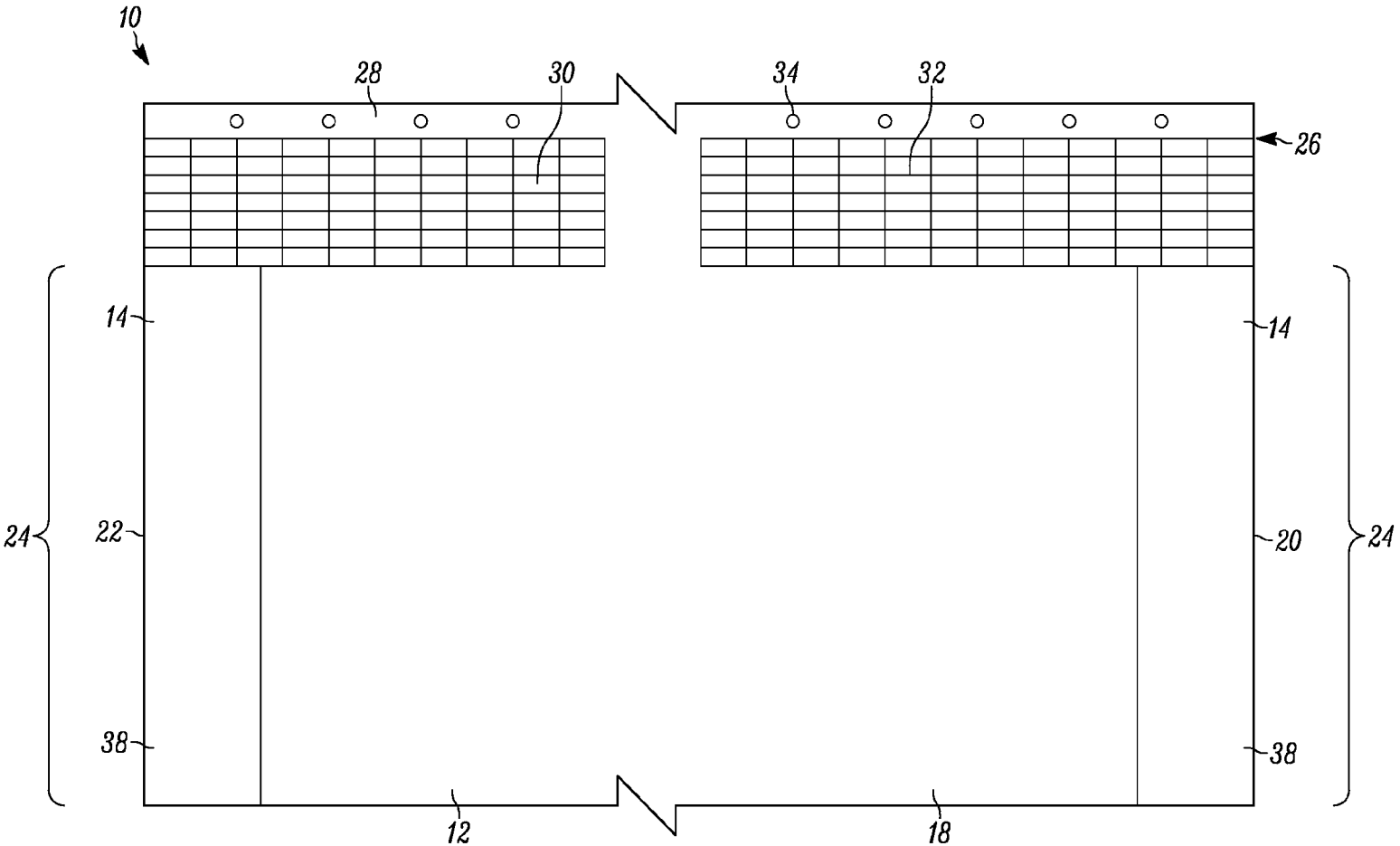
FIG. 1B is a schematic illustration showing an opposite second side of the privacy curtain assembly in FIG. 1A.

The present disclosure relates generally to a privacy curtain and, more particularly, to a privacy curtain having one or more panels that may be cleaned, wiped, and disinfected in place without removing the panels from the curtain. As representative of one aspect of the present disclosure, FIGS. 1A-B show a privacy curtain assembly 10 configured to partially or completely separate a patient's bed (not shown) from the rest of a hospital room (e.g., by partially or completely encircling the bed). As described below, the privacy curtain assembly 10 includes at least one permanently affixed cleanable panel 14 that can be easily cleaned and disinfected in place by, for example, wiping, to prevent the spread of bacteria and germs without the need to completely replace or remove the curtain. In some instances, for example, the privacy curtain assembly 10 may only be wipable by hand (e.g., when suspended above a floor), thereby obviating the need to remove the privacy curtain assembly from its suspended position for machine washing. Not only does the privacy curtain assembly 10 reduce or prevent cross-contamination by caregivers handling the assembly, it also reduces labor cost and turnover time by reducing the need for a curtain change.

Figure 2A:
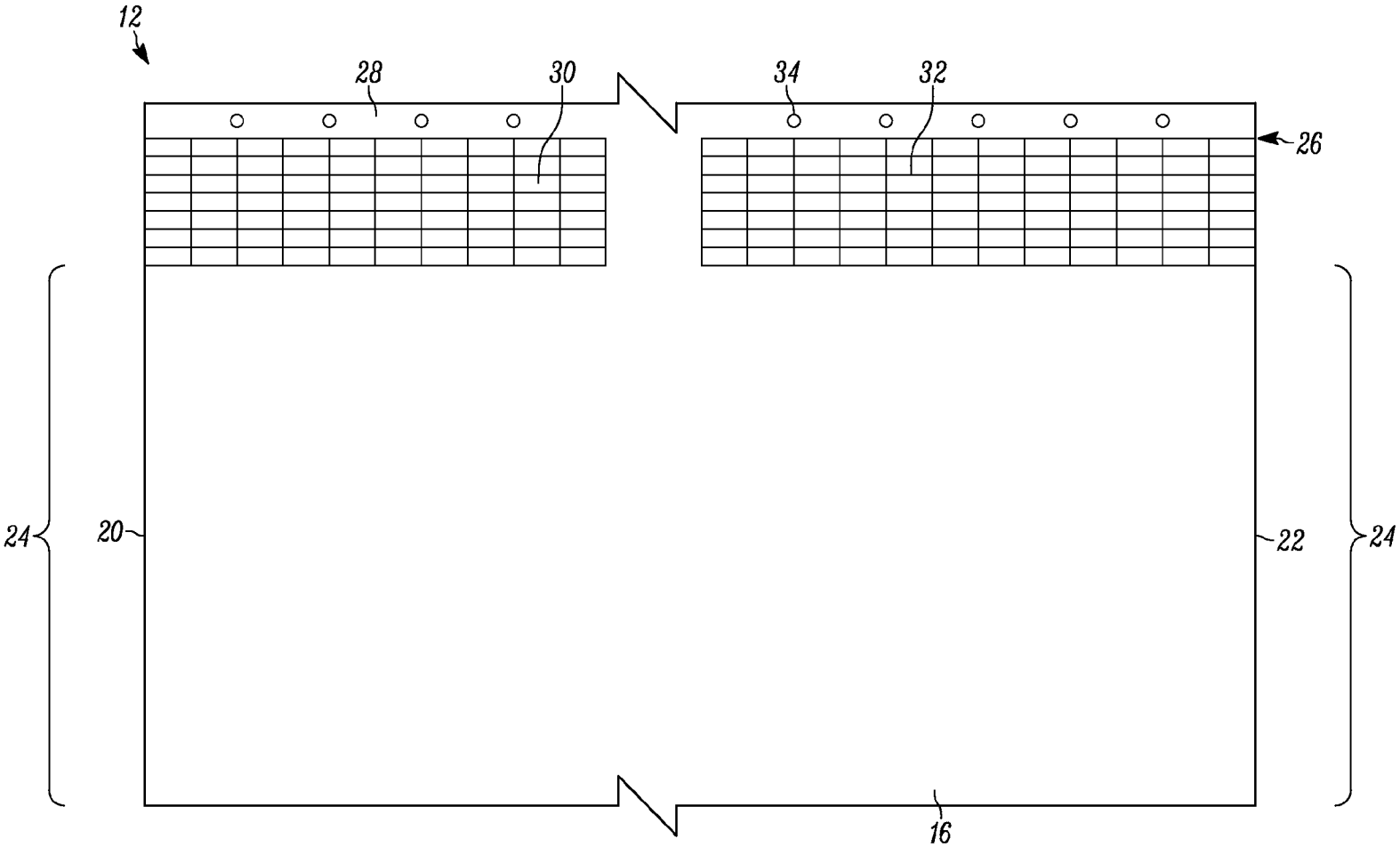
FIG. 2A is a schematic illustration showing a first side of a main curtain portion of the privacy curtain assembly in FIG. 1A.
Figure 2B:
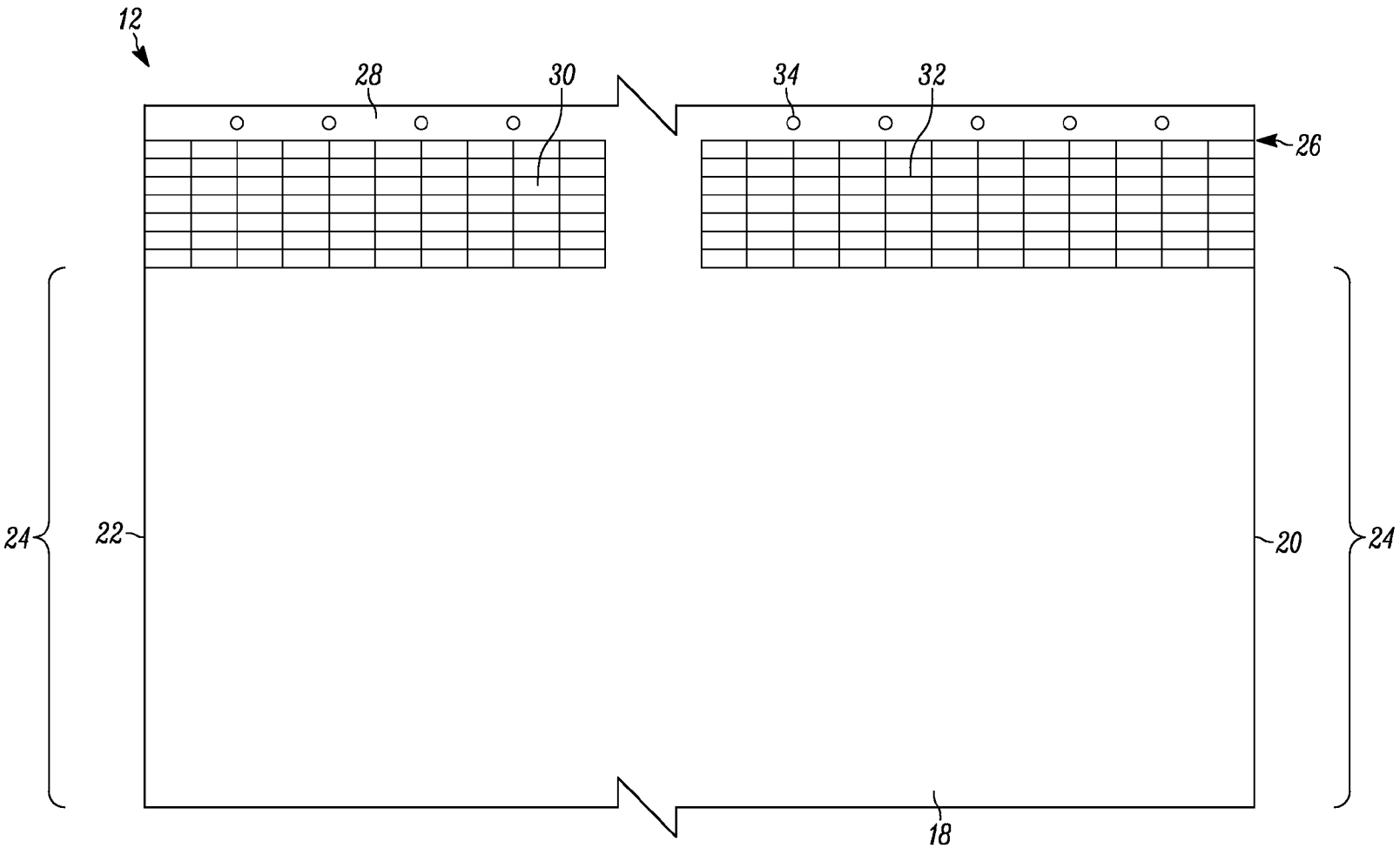
FIG. 2B is a schematic illustration showing an opposite second side of the main curtain portion of the privacy curtain assembly in FIG. 1A.

In one aspect, the privacy curtain assembly 10 includes a main curtain portion 12 (FIGS. 2A-B). The main curtain portion 12 includes a first side 16 (FIG. 2A) and an oppositely disposed second side 18 (FIG. 2B). The main curtain portion 12 also includes a first leading edge 20 oppositely disposed from a second leading edge 22. Additionally, the main curtain portion 12 includes mating portions 24 configured to engage all or only a portion of a cleanable panel 14 (FIGS. 1A-B). The main curtain portion 12 can have a rectangular shape as shown in FIGS. 2A-B; however, it will be appreciated that the main curtain portion can have other shapes as well, such as circular, triangular, square, trapezoidal, etc. The main curtain portion 12 can be made from a sheet of any suitable natural or artificial material, such as cloth (e.g., cotton), silk, rubber, paper, plastic, etc., capable of withstanding multiple laundering cycles.

Figure 3:
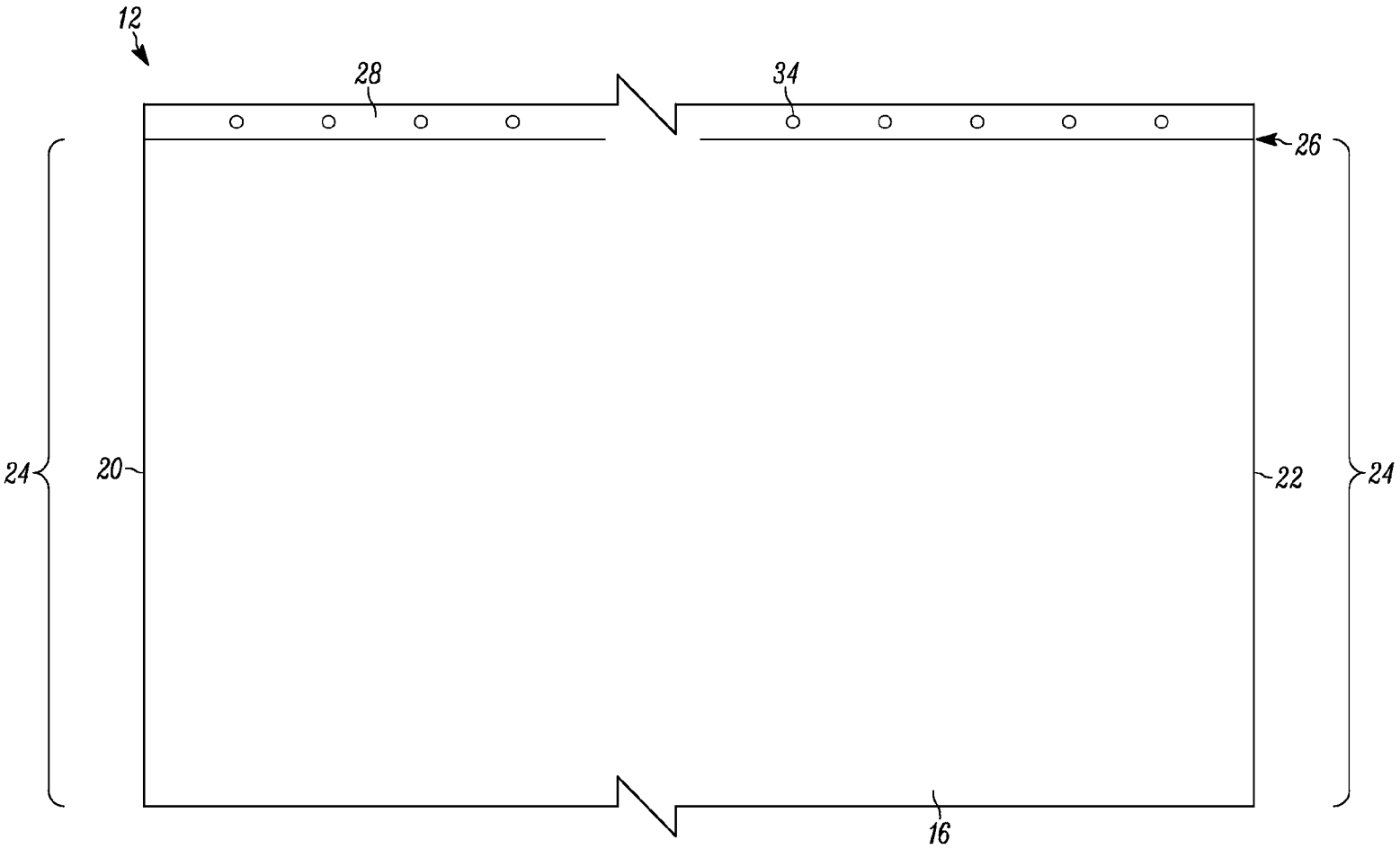
FIG. 3 is a schematic illustration showing an alternative configuration of the main curtain portion of the privacy curtain assembly in FIG. 1A.

In another aspect, the main curtain portion 12 includes an attachment portion 26 that is securely attached to, or integrated with, the main curtain portion. The attachment portion 26 typically includes an upper portion 28 adapted for suspension of the entire privacy curtain assembly 10 and a lower portion 30 adapted to facilitate the passage of light, air, and water (e.g., from fire sprinklers) from a curtain-divided portion of the room to another such portion of the room. The lower portion 30 connects the upper portion 28 to the main curtain portion 12. As shown in FIG. 3, the attachment portion 26 can alternatively include only the upper portion 28, which may be directly attached to the main curtain portion 12. The upper portion 28 and the lower portion 30 are configured to extend across a width W of the privacy curtain assembly 10. The upper portion 28 is configured to suspend the privacy curtain assembly 10 from a ceiling or a ceiling/wall mounted track of a hospital room (not shown). The upper portion 28 and/or the lower portion 30 can be made of the same or different materials as the main curtain portion 12. In one example, the lower portion 30 can be made of a flexible, mesh-like material 32.

The attachment portion 26 includes at least one suspending mechanism 34. The at least one suspending mechanism 34 is configured to elevate the privacy curtain assembly 10 above a floor (not shown), such as a hospital room floor. In one example, the at least one suspending mechanism 34 can include an opening configured to engage a ceiling-mounted hook (not shown). In another example, the at least one suspending mechanism 34 can include a loop, snap, Velcro strip, or any other suitable mechanism for suspending the privacy curtain assembly 10 above a floor.

In another aspect, the privacy curtain assembly 10 includes at least one cleanable, wipable panel 14 (FIG. 4) that is permanently affixed to one of the mating portions 24 of the main curtain portion 12 by, for example, stitching, sewing or adhesives. Each panel 14 is configured to be cleaned and disinfected in place by wiping, for example, without the need to remove the panel from the privacy curtain assembly 10. Generally, each of the panels 14 is configured to be wide enough to ensure that a person's hands will not reach or touch the main curtain portion 12 (which is unprotected from bacteria or germs) but narrow enough so as to not impede the opening and closing of the privacy curtain assembly 10.

Figure 4B:
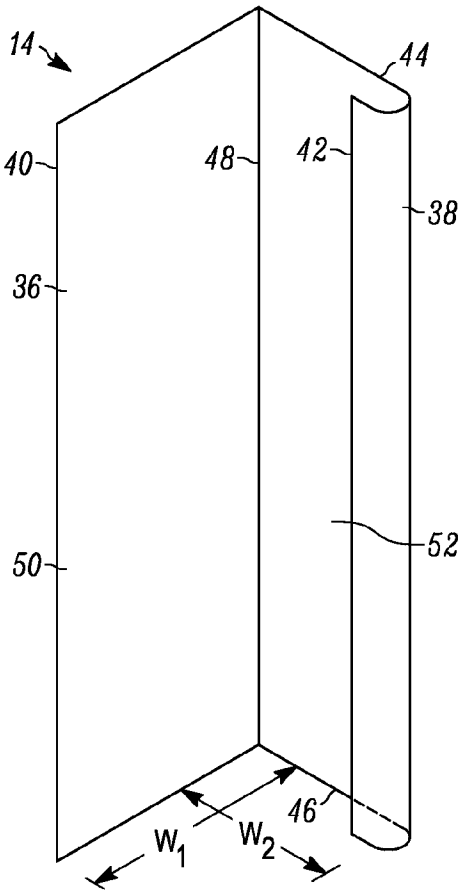
FIG. 4B is a perspective view showing an alternative configuration of the panel in FIG. 4A.
Figure 4A:
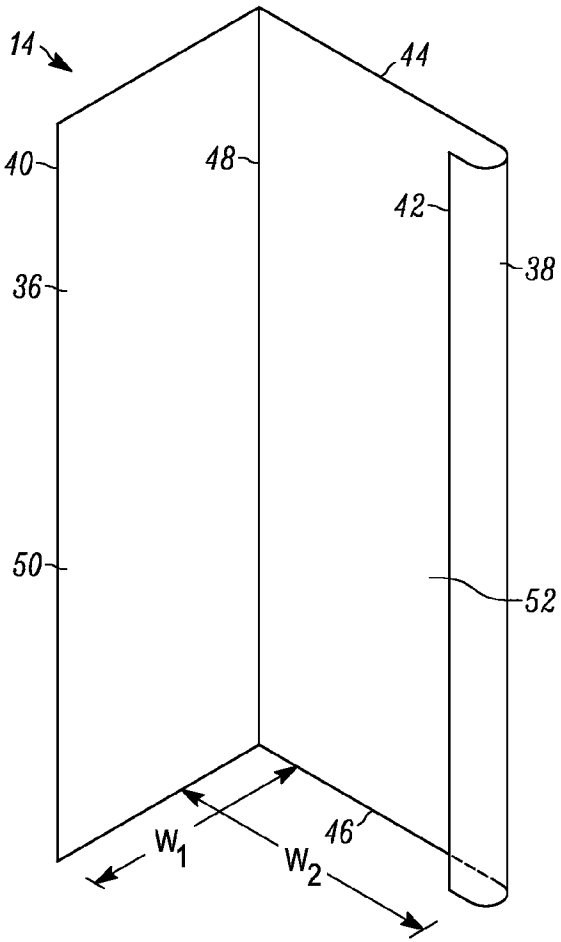
FIG. 4A is a perspective view of a cleanable panel comprising the privacy curtain assembly in FIG. 1A.

Each panel 14 includes oppositely disposed first and second surfaces 36 and 38. Each panel 14 also includes a first vertical leading edge 40 oppositely disposed from a second vertical leading edge 42, as well as a third horizontal leading edge 44 oppositely disposed from a fourth horizontal leading edge 46. As shown in FIGS. 4A-B, a crease line 48 extends longitudinally between the third leading edge 44 and the fourth leading edge 46 to form a first portion 50 adjacent a second portion 52. The first and second portions 50 and 52 of each panel 14 are configured to directly contact the mating portions 24 on the first and second sides 16 and 18 of the main curtain portion 12, respectively. As shown in FIG. 4A, the crease line 48 can be centrally located between the third and fourth leading edges 44 and 46 so that each of the first portion 50 and the second portion 52 have a width $w_1$ and $w_2$ that are equal to (or about equal to) one another. In one example, each of the first and second widths $w_1$ and $w_2$ can be at least about 6 inches. In another example, each of the first and second widths $w_1$ and $w_2$ can be about 9 inches. Alternatively, as shown in FIG. 4B, the crease line 48 can be offset from the center of the panel 14 so that the width $w_1$ of the first portion 50 is greater than the width $w_2$ of the second portion 52. In other instances, the width $w_2$ of the second portion 52 can be greater than the width $w_1$ of the first portion 50. The crease line 48 is configured to directly contact and envelop the respective first or second leading edge 20 and 22 of the main curtain portion 12.

Each panel 14 can have a rectangular shape as shown in FIGS. 4A-B; however, it will be appreciated that each panel can have other shapes as well, such as circular, triangular, square, trapezoidal, crescent-shaped, etc. Each panel 14 can include one or a combination of colors, such as beiges and/or graphic design elements (e.g., cartoon characters). Each panel 14 can have the same or different color(s) and/or graphic design element(s) than the other panel(s). Each panel 14 can be made of one or more materials such that each cleanable panel is anti-static, non-absorbent, anti-bacterial, self-deodorizing, flame-resistant, moisture-resistant, and/or fluid-resistant. The material used to make each panel 14, however, need not be anti-septic or anti-microbial because the panels may be cleaned and disinfected in place (e.g., using a disinfectant). In one example, a panel 14 can be made of Sure-Chek® (Herculite, Inc., Emigsville, Pa.). It will be appreciated that the panel 14 can be made of any other suitable material (or materials) to enable each panel to be cleaned and disinfected in place (e.g., by wiping) and be capable of withstanding multiple laundering cycles. It will also be appreciated that two or more panels 14 can be made of the same or different materials.

Figure 5A:
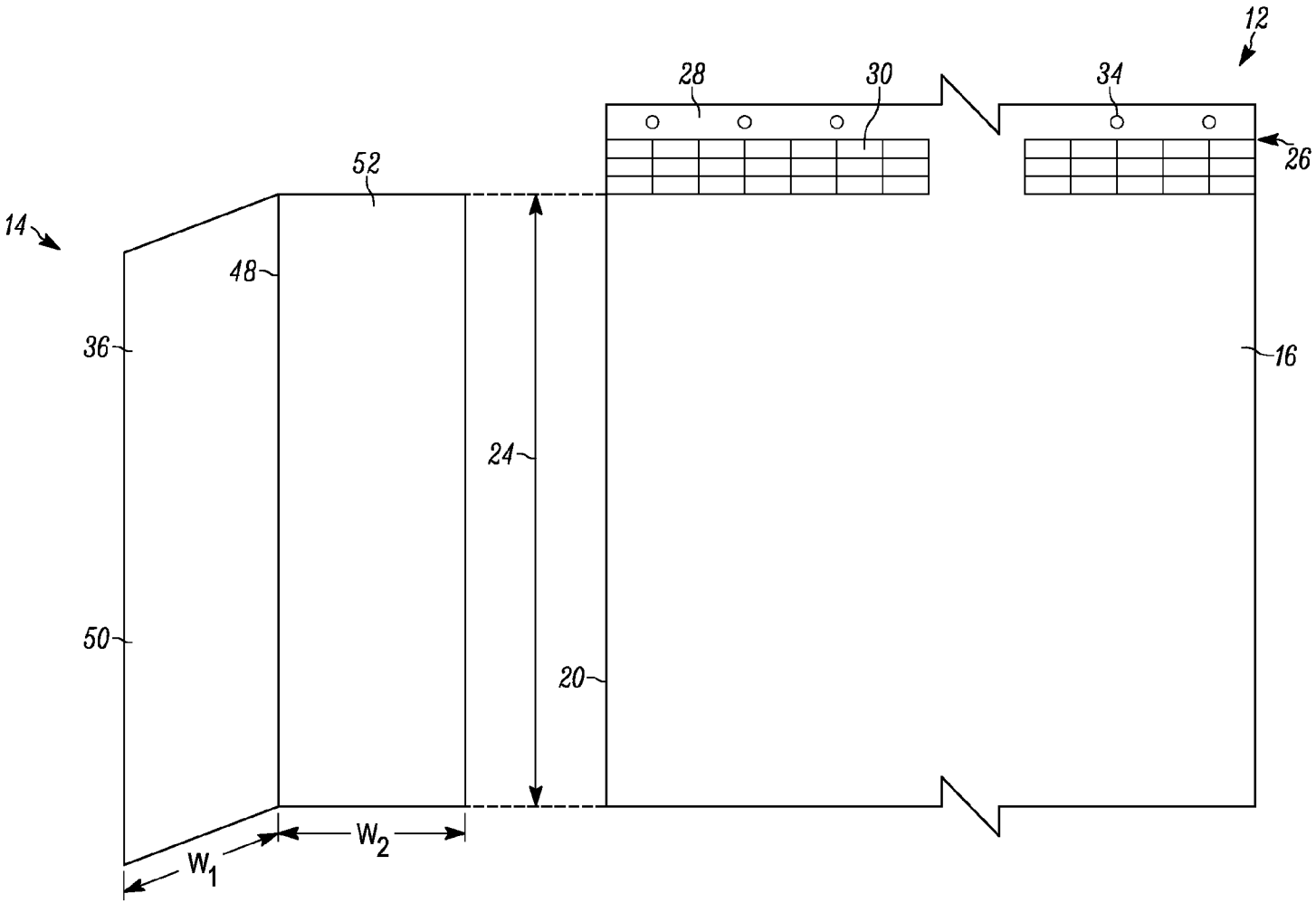
FIG. 5A is an exploded view of the main curtain portion and the panel comprising the privacy curtain assembly in FIG. 1A.
Figure 5B:
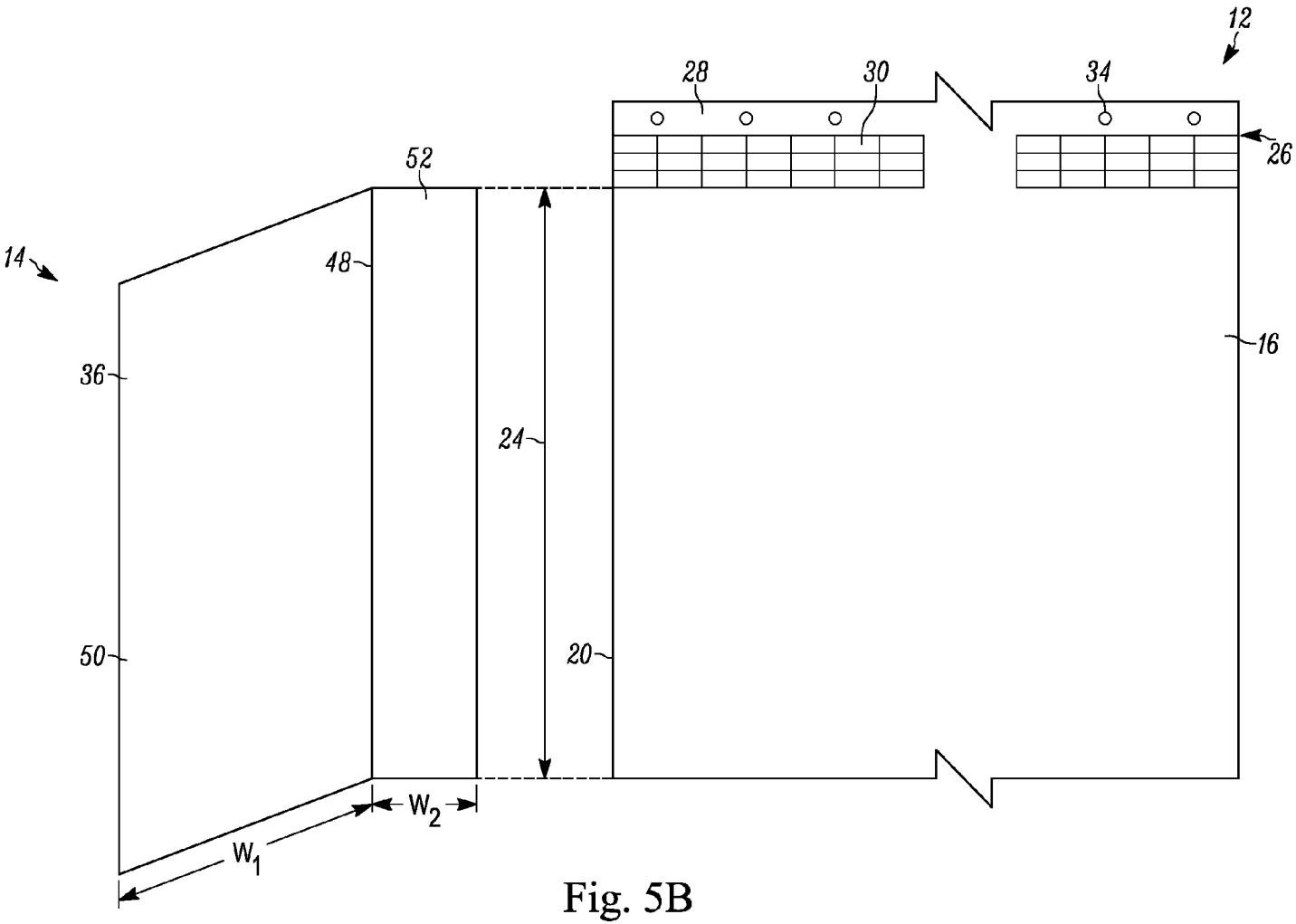
FIG. 5B is an exploded view showing an alternative configuration of the main curtain portion and the panel comprising the privacy curtain assembly in FIG. 5A.
Figure 5C:
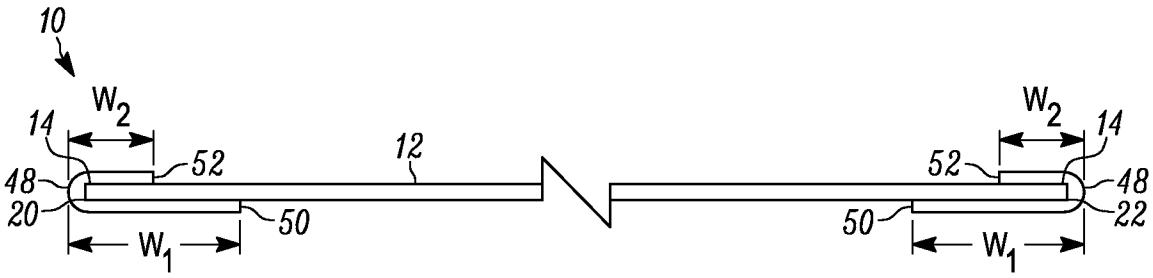
FIG. 5C is a top view of the privacy curtain assembly in FIG. 5B.

In one example, the panels 14 are positioned about the main curtain portion 12 so that the crease line 48 of each of the panels contacts and envelops the entire first and second leading edges 20 and 22 of the main curtain portion (FIG. 5A-C). In this configuration, the first portion 50 of each panel 14 contacts the first side 16 of the main curtain portion 12, and the second portion 52 of each panel contacts the second side 18 of the main curtain portion.

Figure 5D:
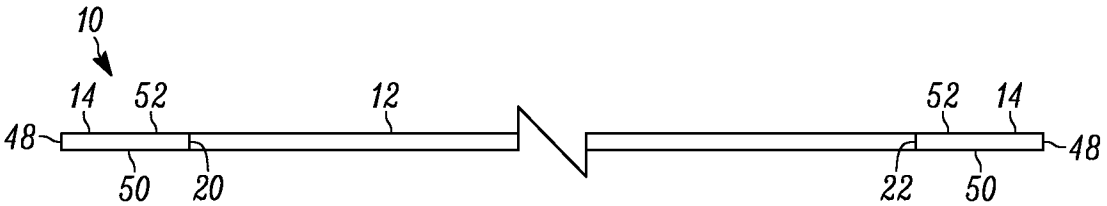
FIG. 5D is a top view showing an alternative configuration of the main curtain portion and the panel comprising the privacy curtain assembly in FIG. 5A.

In another example, the first leading edge 40 and the second edge 42 of a panel 14 can directly contact or abut the first or second leading edge 20 or 22 of the main curtain portion 12 (FIG. 5D). In this configuration, the first and second portions 50 and 52 of each panel 14 do not contact the first and second sides 16 and 18 of the main curtain portion 12, respectively. Instead, the crease line 48 is spaced apart from the first or second leading edge 20 or 22 of the main curtain portion 12.

Figure 5E:
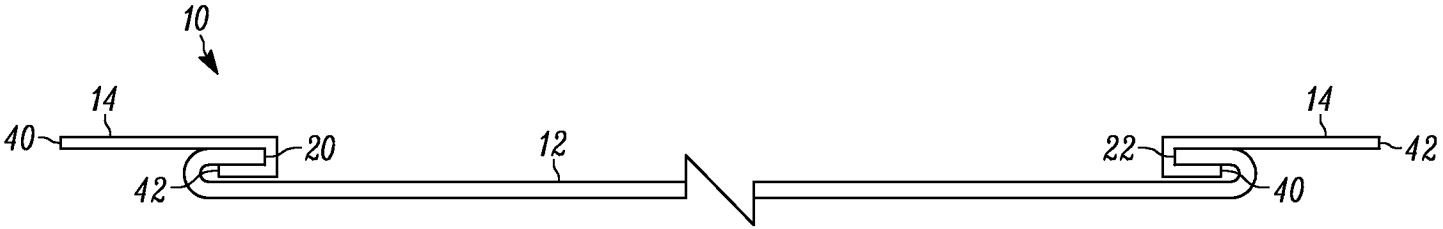
FIG. 5E is a top view showing an alternative configuration of the main curtain portion and the panel comprising the privacy curtain assembly in FIG. 5A.

In another example, the privacy curtain assembly 10 can be configured so that the first portion 50 or the second portion 52 of the panel 14 is free from attachment to the main curtain portion. As shown in FIG. 5E, for instance, a panel 14, such as the one shown in FIG. 4B, can be securely attached to the main curtain portion 12 so that the second portion 52 is attached to the main curtain portion and at least a portion of the first portion 50 is free from attachment to the main curtain portion. In this configuration, the first portion 50 or the second portion 52 of the panel 14 that is free from attachment to the main curtain portion 12 can serve as a handle for manipulating the privacy curtain assembly 10 without actually touching the main curtain portion 12.

Figure 5F:
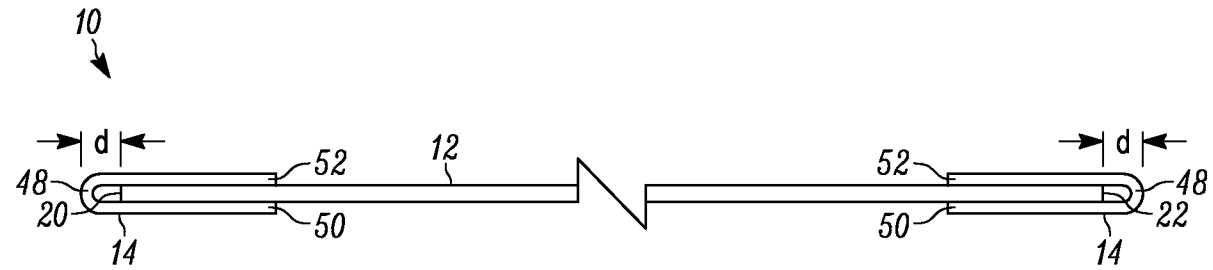
FIG. 5F is a top view showing an alternative configuration of the main curtain portion and the panel comprising the privacy curtain assembly in FIG. 5A.
Figure 5G:
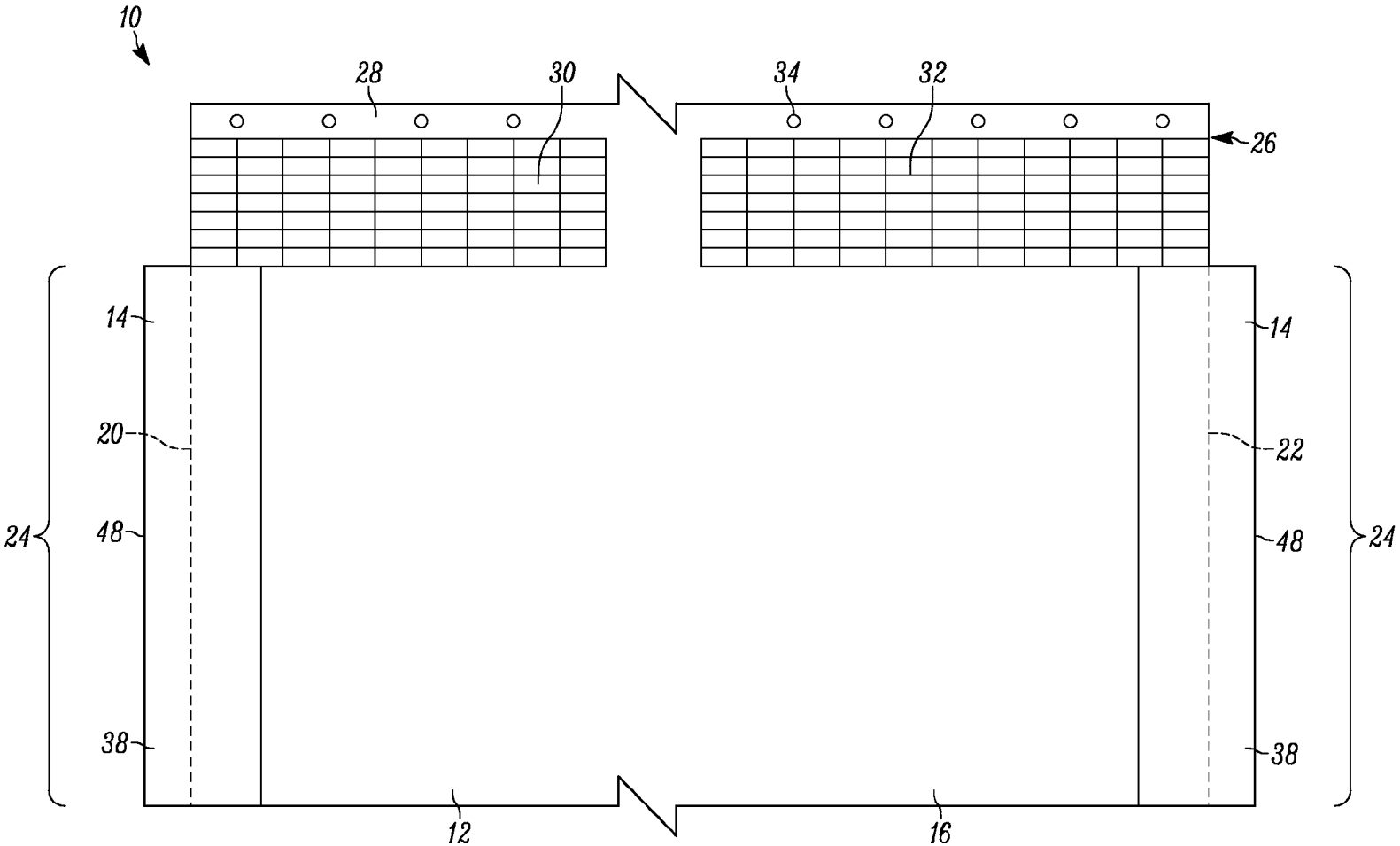
FIG. 5G is a schematic illustration showing the main curtain portion of the privacy curtain assembly in FIG. 5F.

In another example, the privacy curtain assembly 10 can be configured so that the crease line 48 of each of the panels 14 is spaced a lateral distance d (FIGS. 5F-G) from the first and second leading edges 20 and 22 of the main curtain portion 12. For instance, a panel 14, such as the one shown in FIGS. 4A-B, can be securely attached to the main curtain portion 12 so that the crease line 48 is free from engagement with the first and second leading edges 20 and 22 of the main curtain portion. In this configuration, the portion of each panel 14 corresponding to the lateral distance d can serve as a handle for manipulating the privacy curtain assembly 10 without actually touching the main curtain portion 12.

Figure 6:
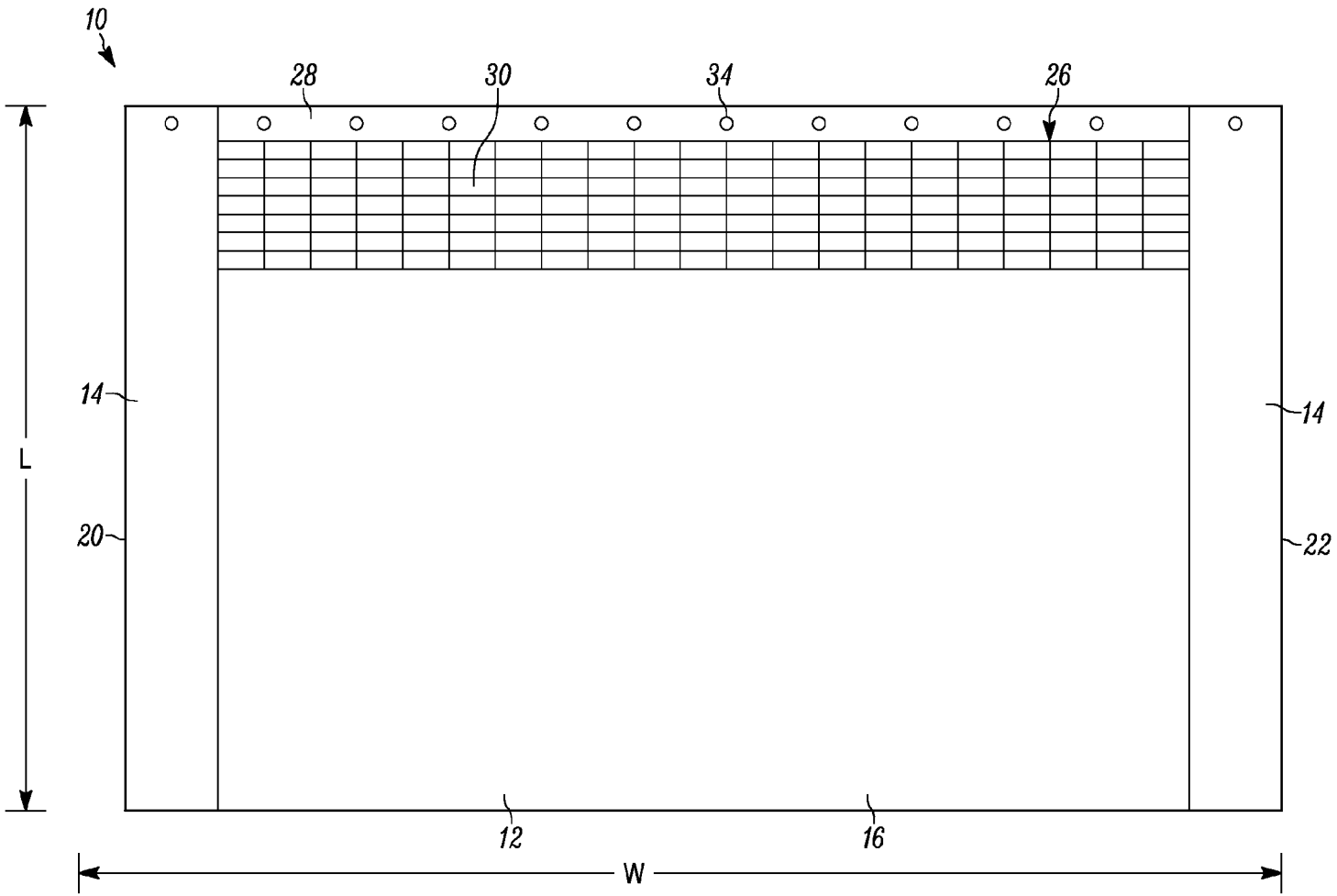
FIG. 6 is a schematic illustration showing an alternative configuration of the privacy curtain assembly in FIG. 1A.
Figure 7:
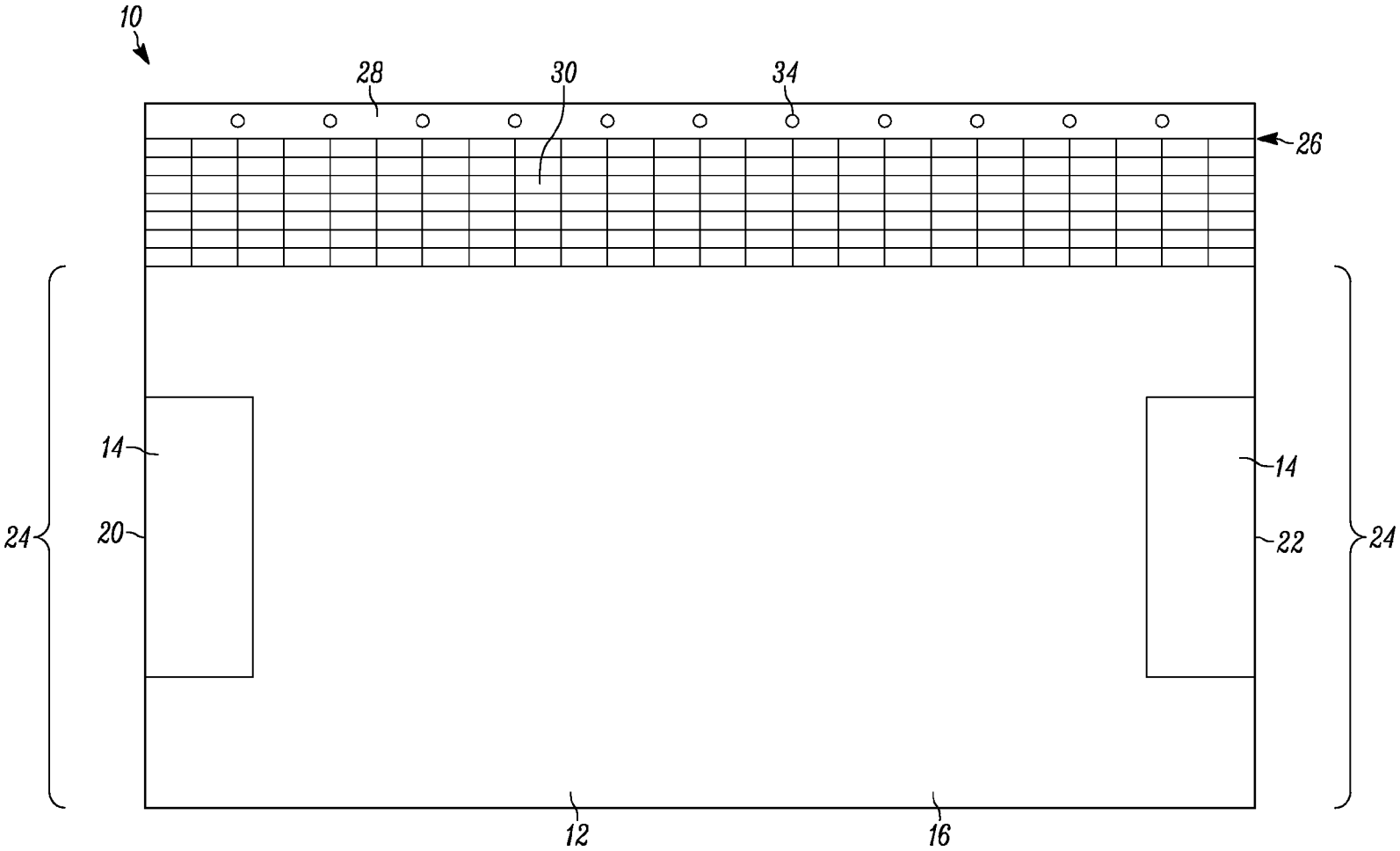
FIG. 7 is a schematic illustration showing another alternative configuration of the privacy curtain assembly in FIG. 1A.

In use, first and second panels 14' and 14" are permanently affixed to separate mating portions 24 of the main curtain portion 12. The first and second panels 14' and 14" may be permanently affixed to the main curtain portion 12 by any suitable mechanism (e.g., stitching, sewing or adhesives). As shown in FIG. 6, the first and second panels 14' and 14" can cover an entire length L of the first or second leading edge 20 or 22 of the main curtain portion 12. Alternatively, the first and second panels 14' and 14" can extend along only a portion of the entire length L (FIG. 7). Once attached, the first surface 36 of each of the first and second panels 14' and 14" contacts the first and second sides 16 and 18 of the main curtain portion 12, and the second surface 38 of each of the first and second panels is exposed to the ambient environment. The second surface 38 can be cleaned in place without having to remove the first and second panels 14' and 14" and without having to replace the entire privacy curtain assembly 10. Alternatively, the second surface 38 of each of the first and second panels 14' and 14" can contact the first and second sides 16 and 18 of the main curtain portion 12 such that the first surface 36 is exposed to the ambient environment. In this case, the first surface 36 can be cleaned in place without having to remove the first and second panels 14' and 14" and without having to replace the entire privacy curtain assembly 10.

Now assembled, the privacy curtain assembly 10 can be suspended from the ceiling of a hospital room or other type of room. A ceiling-mounted bracket with hooks (not shown), for example, can engage the at least one suspending mechanism 34 of the attachment portion 26 of the main curtain portion 12. After the privacy curtain assembly 10 is suspended, the privacy curtain assembly is moved along the bracket so that the privacy curtain assembly partially or completely encircles a patient's bed. Medical staff can now manipulate the privacy curtain assembly 10 as needed by, e.g., grasping a panel 14 to position the privacy curtain assembly around the patient's bed. Typically, constant handling of conventional curtain assemblies increases the likelihood that germs will be present on the edges or sides of the panels. Advantageously, the panels 14 of the privacy curtain assembly 10 can be cleaned in place by, e.g., wiping all or only a portion of the panels 14 with a disinfectant and without having to remove the entire privacy curtain assembly. Additionally, frequent cleaning of the panels 14 not only helps to minimize contamination, but also increases patient comfort and satisfaction that their room is sanitary.

From the above description of the present disclosure, those skilled in the art will perceive improvements, changes, and modifications. Such improvements, changes, and/or modifications are within the skill of the art and are intended to be covered by the appended claims.

What is claimed is:

1. A privacy curtain assembly consisting of:

i) a main curtain portion including:

a first side;

a second side oppositely disposed from the first side, each of the first and second sides including first and second mating portions, respectively;

oppositely disposed first and second leading edges;

an attachment portion including an upper attachment portion and a lower attachment portion, the lower attachment portion connecting the upper attachment portion to the main curtain portion and being made of a flexible, mesh material, and the upper attachment portion including an attachment mechanism, each of the upper and lower attachment portions extending along an entire width of the privacy curtain assembly;

ii) a first cleanable, wipeable panel permanently affixed to the first mating portion of the main curtain portion by at least one first attachment mechanism and covering an entire length of the first leading edge, the first panel including:

first and second portions in contact with the first and second sides of the main curtain portion, respectively, the first and second portions being separated by a first substantially linear crease that envelops the first leading edge, the first portion having a first width that is greater than a second width of the second portion; and a first surface in contact with the first and second sides of the main curtain portion and a second surface exposed to an ambient environment; and iii) a second cleanable, wipeable panel permanently affixed to the second mating portion of the main curtain portion by at least one second attachment mechanism and covering an entire length of the second leading edge, the second panel including:

first and second portions in contact with the first and second sides of the main curtain portion, respectively, the first and second portions being separated by a second substantially linear crease that envelops the second leading edge;

the first portion having a first width that is greater than a second width of the second portion and a first surface in contact with the first and second sides of the main curtain portion and a second surface exposed to the ambient environment;

wherein each of the first and second panels is made of a material that is at least one of anti-static, non-absorbent, anti-bacterial, self-deodorizing, flame-resistant, moisture-resistant, and fluid resistant, wherein the first and second panels are configured to be cleaned and disinfected while permanently affixed to the main curtain portion and while the privacy curtain assembly is suspended above a floor.

2. The privacy curtain assembly of claim 1, wherein the main curtain portion is substantially rectangular.

3. The privacy curtain assembly of claim 1, wherein the first panel and the second panel are substantially rectangular.

4. The privacy curtain assembly of claim 1, being configured to at least partially separate a patient's bed from the rest of a room.

5. The privacy curtain assembly of claim 1, wherein the attachment portion includes at least one suspending mechanism for suspending the privacy curtain assembly above the floor.

6. The privacy curtain assembly of claim 5, wherein the upper attachment portion includes the at least one suspending mechanism.

7. The privacy curtain assembly of claim 6, wherein the lower attachment portion is configured to allow air, light, and water from fire sprinklers into at least a portion of a room.

8. A privacy curtain assembly consisting of:

i) a main curtain portion including:

a first side;

a second side oppositely disposed from the first side, each of the first and second sides including first and second mating portions, respectively;

oppositely disposed first and second leading edges;

an attachment portion including an upper attachment portion and a lower attachment portion, the lower attachment portion connecting the upper attachment portion to the main curtain portion and being made of a flexible, mesh material, and the upper attachment portion including an attachment mechanism, each of the upper and lower attachment portions extending along an entire width of the privacy curtain assembly;

ii) a first cleanable, wipeable panel permanently affixed to the first mating portion of the main curtain portion by at least one first attachment mechanism, the first panel including:

first and second portions in contact with the first and second sides of the main curtain portion, respectively, the first and second portions being separated by a first substantially linear crease that envelops the first leading edge; and a first surface in contact with the first and second sides of the main curtain portion and a second surface exposed to an ambient environment; and iii) a second cleanable, wipeable panel permanently affixed to the second mating portion of the main curtain portion by at least one second attachment mechanism, the second panel including:

first and second portions in contact with the first and second sides of the main curtain portion, respectively, the first and second portions being separated by a second substantially linear crease that envelops the second leading edge; and a first surface in contact with the first and second sides of the main curtain portion and a second surface exposed to the ambient environment;

wherein each of the first and second panels is made of a material that is at least one of anti-static, non-absorbent, anti-bacterial, self-deodorizing, flame-resistant, moisture-resistant, and fluid resistant, wherein the first and second panels are configured to be cleaned and disinfected while permanently affixed to the main curtain portion and while the privacy curtain assembly is suspended above a floor.

9. The assembly of claim 8, wherein the first portion of the first panel has a first width that is greater than a second width of the second portion of the first panel, and the first portion of the second panel has a first width that is greater than a second width of the second portion of the second panel.

10. The assembly of claim 8, wherein the first portion of the first panel has a first width that is about equal to a second width of the second portion of the first panel, and the first portion of the second panel has a first width that is about equal to a second width of the second portion of the second panel.

11. The assembly of claim 8, wherein the first panel covers an entire length of the first leading edge, and the second panel covers an entire length of the second leading edge.

12. The assembly of claim 8, wherein the first panel covers at least a part of a length of the first leading edge, and the second panel covers at least a part of a length of the second leading edge.

13. The assembly of claim 8, wherein the main curtain portion is substantially rectangular.

14. The assembly of claim 8, wherein the first panel and the second panel are substantially rectangular.

15. The privacy curtain assembly of claim 8, being configured to at least partially separate a patient's bed from the rest of a room.

16. The privacy curtain of claim 8, wherein the attachment portion includes at least one suspending mechanism for suspending the privacy curtain assembly above the floor.

17. The privacy curtain of claim 16, where the upper attachment portion includes the at least one suspending mechanism.

18. The privacy curtain of claim 17, wherein the lower attachment portion is configured to allow air, light, and water from fire sprinklers into at least a portion of a room.

* * * * *